US009266383B2

(12) United States Patent
Patrou et al.

(10) Patent No.: US 9,266,383 B2
(45) Date of Patent: Feb. 23, 2016

(54) THREE DIMENSIONAL VISUAL DISPLAY DEVICE KIT

(71) Applicants: Lou George Patrou, Tarrytown, NY (US); John Dallas Phelps, Yonkers, NY (US)

(72) Inventors: Lou George Patrou, Tarrytown, NY (US); John Dallas Phelps, Yonkers, NY (US)

( * ) Notice: Subject to any disclaimer, the term of this patent is extended or adjusted under 35 U.S.C. 154(b) by 0 days.

(21) Appl. No.: 14/255,879

(22) Filed: Apr. 17, 2014

(65) Prior Publication Data

US 2014/0314970 A1 Oct. 23, 2014

Related U.S. Application Data

(60) Provisional application No. 61/813,370, filed on Apr. 18, 2013.

(51) Int. Cl.

| | |
|---|---|
| ***B44C 5/00*** | (2006.01) |
| ***G09F 1/06*** | (2006.01) |
| ***B44C 5/06*** | (2006.01) |

(52) U.S. Cl.

CPC ... *B44C 5/00* (2013.01); *B44C 5/06* (2013.01); *G09F 1/06* (2013.01)

(58) Field of Classification Search

USPC ..... 40/539; 47/41.12; D11/117; 229/114, 229/117.14

See application file for complete search history.

(56) References Cited

U.S. PATENT DOCUMENTS

| | | | | |
|---|---|---|---|---|
| 2,138,984 | A * | 12/1938 | Rounds | 206/443 |
| 4,143,191 | A * | 3/1979 | Chavis | 428/13 |
| 6,564,490 | B1 * | 5/2003 | Avila | 40/745 |
| 7,000,347 | B2 * | 2/2006 | Roskin | 47/41.11 |

* cited by examiner

*Primary Examiner* — Joanne Silbermann

(57) ABSTRACT

A three dimensional visual display device kit made of paper or plastic materials, comprising a multitude of interchangeable stemmed panels of varying shaft lengths and shapes for user to insert into a decorative collapsible base structure that houses a foam-like material for anchoring stemmed image panels. Said stemmed panels having printed graphics and visual enhancements. A support structure attached to top of base structure with multiple slits to stabilize, space and support upright angled stemmed panels. To be assembled into a free standing three-dimensional arrangement of blooming panels that can be viewed from multiple angles like a bouquet of flowers.

7 Claims, 8 Drawing Sheets

THREE DIMENSIONAL VISUAL DISPLAY DEVICE KIT

The present invention relates to the fields of stationery and decorative paper party goods and consumer crafting kits for amusement and entertainment.

A new 3-dimensional visual display device, in kit form, made in the family of paper for the greeting card, party and novelty markets.

The device comprises a collapsible decorative box-like structure that houses and hides from plain view an anchoring hard foam, and serves as the base of the display device. Connected to the base unit structure, a top panel with multiple slits, receives, angles, spaces, supports, organizes, and stabilizes multiple user inserted flat image panels in generally upright and outward angles from the base structure through the slits, creating an attractive, decorative blooming 3-Dimensional display.

The individual panels of various contour shapes, designs and lengths, having printed graphics and or coloring-book style outlines to be colored by user or for sticker applications by user. Additionally, the individual flat image panels having embossments, sparkles and decorative embellishments such as streamers, ribbons and reflective materials. Alternate versions will utilize multi-dimensional image panels to create more dimensionality and pictorial detail.

The visual display device kit is partially unassembled for several reasons; to economize packaging and user mailing, to minimize manufacturing costs, to create a smaller retail shelf space footprint, to provide user activity, and to offer a variety of user customization.

User assembles a unique design arrangement because the image panels are placed randomly by user into different slits and anchored at varying depths into the foam in the base unit structure.

BACKGROUND OF THE INVENTION

The invention evolves from the arts of graphic design and paper engineering of three dimensional paper structures and is geared for manufacture within the paper converting industry: die cutting, embossing, gluing, die stamping & folding, and printing of paper based materials.

Users create a unique visual display by assembling the base unit structure and inserting individual flat image panel shafts through the slits of the top panel and down into the anchoring foam material beneath it, forming an upright arcing "blooming" arrangement, creating a three-dimensional bouquet of image panels that can be viewed from all sides.

Alternate versions will provide further crafting and customization activities such as coloring, decorating and applying stickers to individual flat image panels.

The invention is intended as a consumer activity, gift, novelty, greeting, game, craft, table centerpiece and/or party decoration, in a variety of different sizes, designs and themes, for amusement, celebration, and decoration.

The visual effect of the user assembled invention is a blooming dimensional spray of image panels from front, back and sides of the assembled display. The inventors have long been in the art of paper design and paper engineering in the sector of stationery and gifts. The present invention is an evolution from a prior invention; Patrou, Phelps U.S. Pat. No. 5,157,852, a 3-dimensional paper display device housed in a clear case in assembled form, also created as a gift and stationery item. The evolution being an un-housed three dimensional pictorial structure viewed from all sides in kit form. The differences and advantages include, less structural design with less paper engineering required, more viewer angles of the display and far less material and manufacturing costs.

Like traditional pop-up greeting cards, the present invention draws from making an inexpensive attractive three-dimensional scenic, themed or decorative paper object with collapsibility for ease of mailing. The present invention goes beyond the typical pop-up three-dimensional greeting cards because it is in kit form. By producing the present invention in kit form, it affords user activity and eliminates substantial assembly costs in manufacturing.

Another difference is that typical pop-up three-dimensional greeting cards are primarily engineered to be seen primarily from a front-on viewing angle due to the constrictions and limitations of 90 degree parallel folding construction design. The present invention provides many more viewing angles because the assembled image panels are in convex semi-circular arrays, not in parallels.

SUMMARY OF THE INVENTION

The object of the invention is to create an inexpensive attractive three-dimensional visual greeting, party or novelty pictorial structure in kit form. The basic look and feel of all designs is a bloom of upright image covered panels coming out of a decorative themed base that can be viewed from front, sides and back. Individual image panels are in a variety of contours that follow the shapes of images they depict furthering the optical illusion of each specific design. The invention lends itself to many different decorative, novelty and seasonal themes.

Because each individual image panel has design and imagery on front and back, and because they are engineered to be placed into carefully spaced arced positions, and because the facing sides of the image panels are directed outward to the viewer, the assembled effect is of a full blooming illusion.

A further object of the invention is that it is light weight for user to be able to mail it in unassembled collapsed form.

Users create a unique attractive visual display by assembling the base structure and inserting individual placeable flat image panels through slits in the top panel and down into anchoring foam hidden from sight inside the base unit structure, forming a blooming arrangement by creating a three-dimensional bouquet of image panels.

Alternate versions will provide user customization activities such as coloring on base unit structure side walls and individual image panels with markers and paints, decorating with fanciful elements such as glitter, ribbons and artificial jewels and applying image stickers.

The invention is intended as a consumer activity, gift, novelty, greeting, game, craft, table centerpiece and/or party decoration, in a variety of different shapes, designs, themes, for amusement, celebration, and decoration.

DETAILED DESCRIPTION OF THE INVENTION

Figure 1:
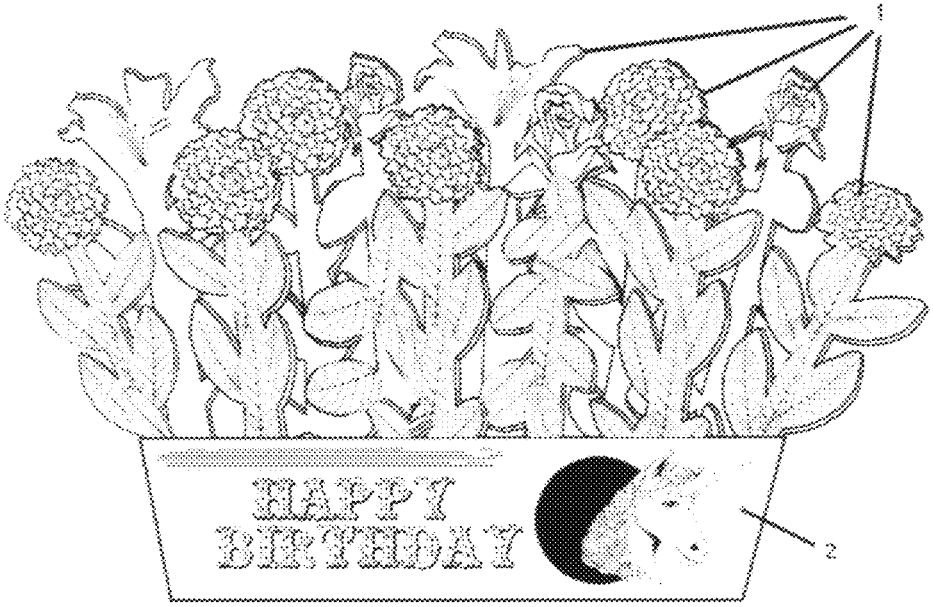
FIG. 1 shows a front elevation view of a display device fully assembled with partial indicia.

FIG. 1 shows a front elevation view of the display device fully assembled, with partial indicia. Individual image panels 1 are seen in a floral-like arrangement coming out of the base unit structure 2 creating a three-dimensional image bloom.

Figure 2:
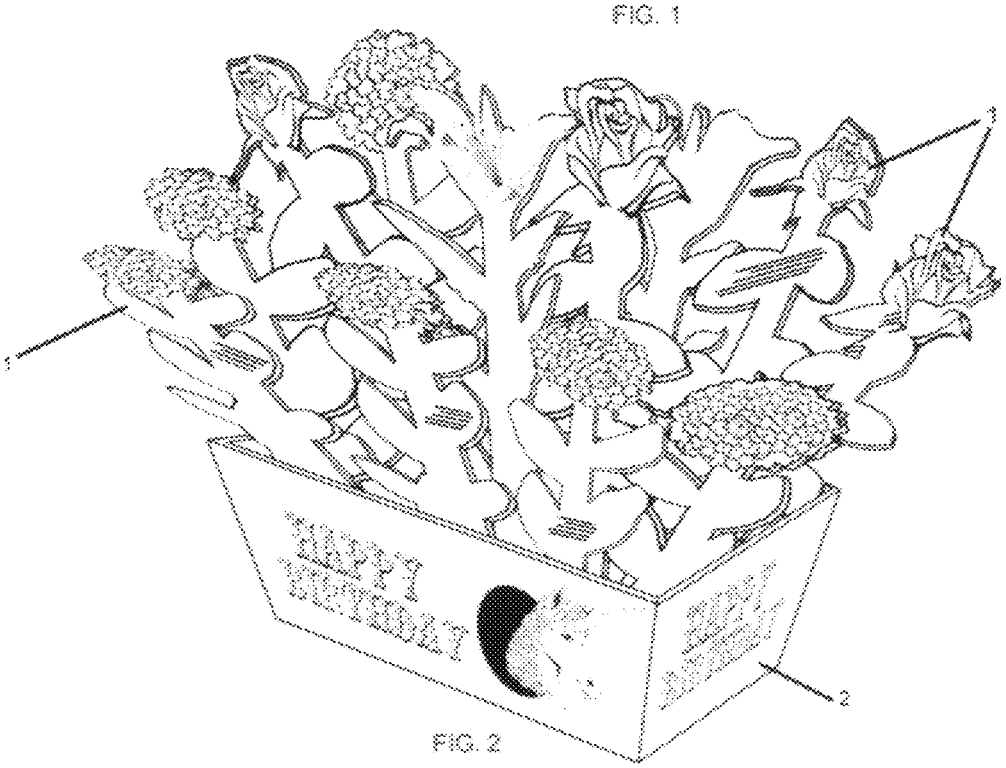
FIG. 2 shows a perspective view of a display device fully assembled with partial indicia.

FIG. 2 shows a perspective view of the display device fully assembled, with partial indicia. Individual image panels 1 are seen in a floral-like arrangement coming out of the base unit structure 2 creating a three-dimensional image bloom that can be viewed from front, back and sides.

Figure 3:
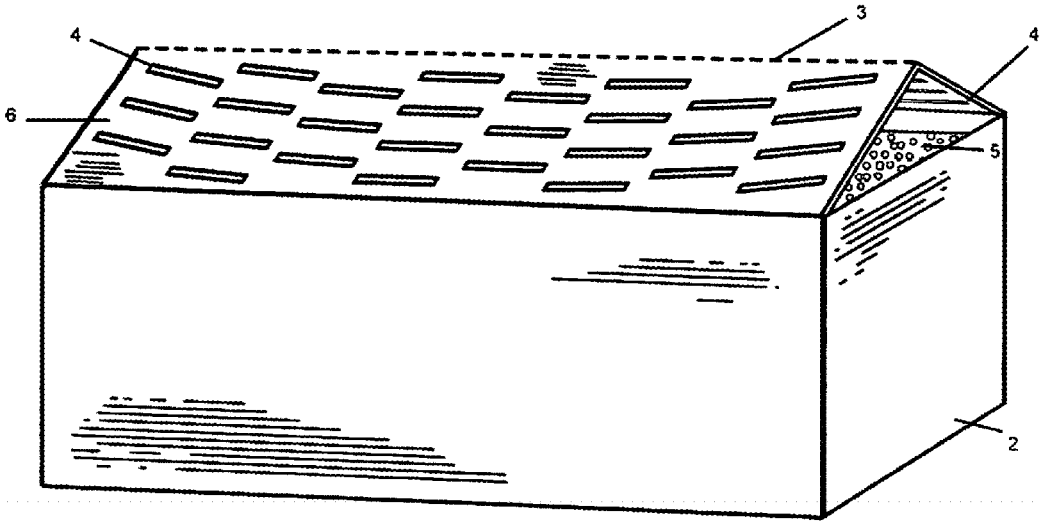
FIG. 3 shows a perspective view of a simple base unit structure with a partially folded gabled top panel.

FIG. 3 shows a perspective view of the assembled base unit structure 2 with partially folded gabled top panel 6 with a fold line 3 at the top of the tent-like configuration, affixed on top of the base unit structure 2, pointed upward with multiple slits 4 on each side of the fold line 3. You can see the foam 5 within the base unit structure 2.

Figure 4:
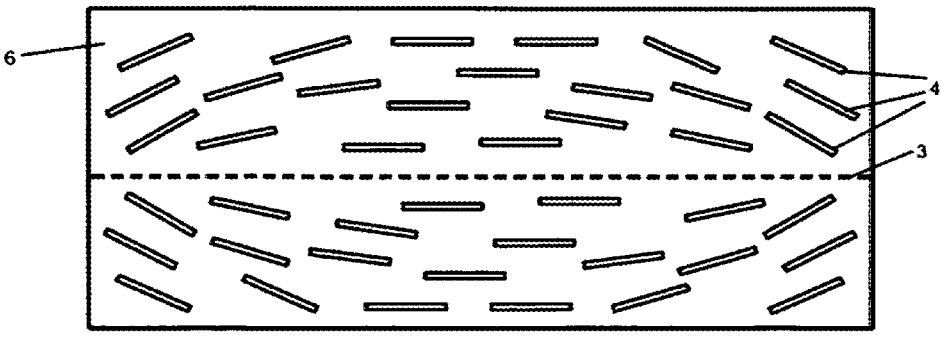
FIG. 4 shows a plan view of a gabled top panel.

FIG. 4 shows a plan view of the gabled top panel 6 and slits 4 in staggered positions to allow the individual image panels to overlap and fill in display area for a fuller visual bloom. There is a fold or score line 3 bisecting the top panel 6 to allow it to be partially folded into a tent-like structure.

FIG. 4 shows the slits 4 as they provide three distinct positioning functions. A—They set the direction of the panel to face the viewer. B—They are positioned in arcs outward toward the viewer to create image panel arrays giving a rounded fullness to the bloom. C—They are placed in overlapping and staggering positions relative to each other to eliminate any voids of imagery and ensure a full illusion.

Figure 5:
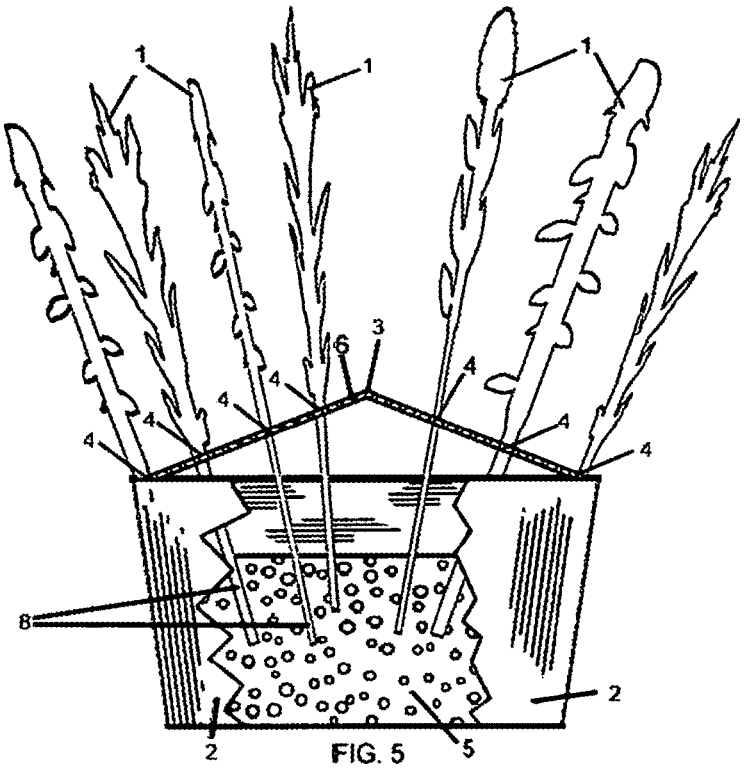
FIG. 5 shows a side elevation view of a fully assembled display device with a partially folded gabled top panel with cut-away view exposing the inserted flat image panels anchored in foam within the bottom of the base unit structure.

FIG. 5 shows a side elevation view of the fully assembled display device. You can see a cut-away view exposing the foam 5 within the bottom of the base unit structure 2. You can see individual image panels 1 with their bottom shafts 8 anchored in the foam 5 at random depths, in generally upward & outward angles and positions. The top panel 6 is in a tent-like configuration, the fold line 3 pointing upwards. The top panel 6 supports, spaces and directs the panels 1 at different distances apart from each other, allows them to lean outward and arranges them in bouquet-like assemblages that can be viewed from all sides. Foam 5 is encased within the base unit structure 2 and hidden from plain view.

Figure 6:
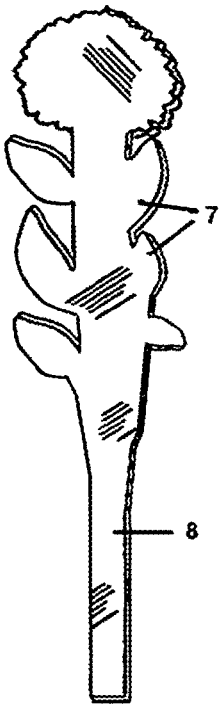
FIGS. 6, 7 and 8 show individual flat image panels of varying contour shapes and lengths.
Figure 7:
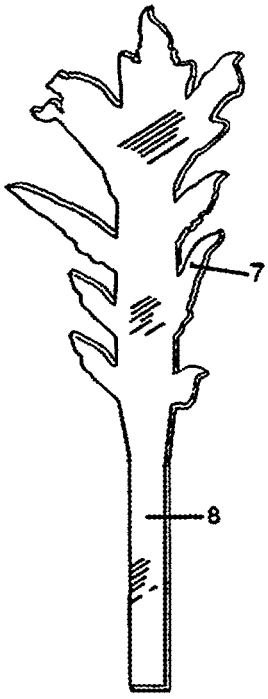
Figure 8:
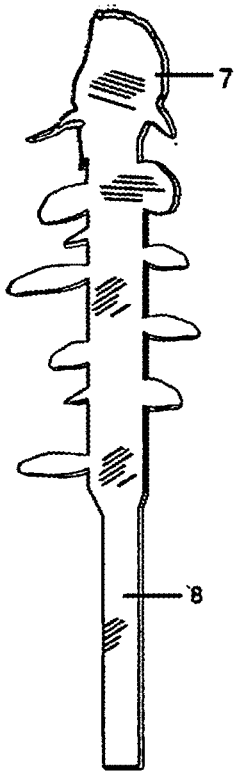

FIGS. 6, 7 and 8 show individual flat image panels of varying contour shapes, widths and lengths. You can see irregular shapes 7 along the sides of the image panels FIGS. 6, 7, 8 that are designed to match pictorial indicia to be disposed. You can see the bottom section of each image panel 8 is small enough to pass through slits in the top panel.

Although some image panels are flat, they could be multi-dimensional.

Figure 9:
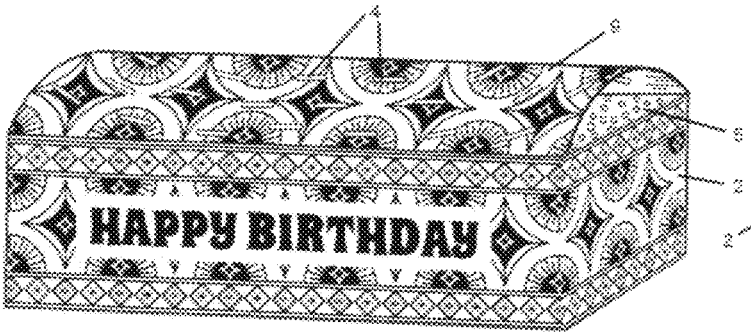
FIG. 9 shows a perspective view of a simple base unit structure with a curved convex shaped top panel with indicia.

FIG. 9 shows a perspective view of a simple base unit structure 2 with indicia on all outer sides, with a curved convex shaped top panel 9 with indicia. You can see foam 5 in the base unit structure 2. You can see the directioning slits 4 in the curved convex shaped top panel 9.

Figure 10:
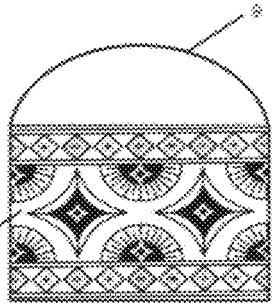
FIG. 10 shows a side elevation view of a simple base unit structure with indicia with a curved convex top panel.

FIG. 10 shows a side elevation view of a simple base unit structure 2 with indicia, with a curved convex shaped top panel 9. You can see the top panel 9 connects to the base housing structure 2.

Figure 11:
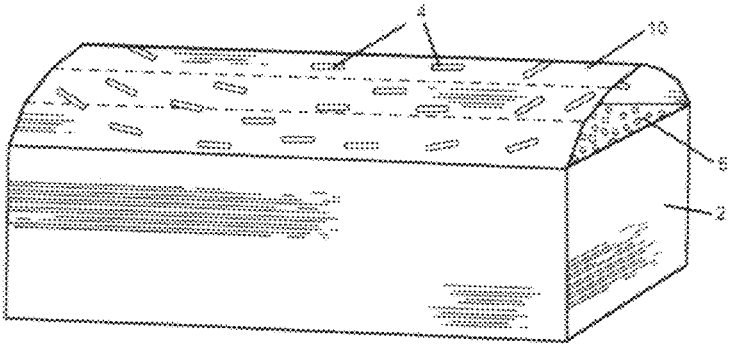
FIG. 11 shows a perspective view of a simple base unit structure with a folded convex shaped top panel.

FIG. 11 shows a perspective view of a simple base unit structure 2 with a folded convex shaped top panel 10 connected to the base unit structure 2. You can see foam 5 in the base unit structure 2.

Figure 12:
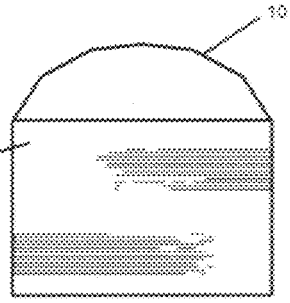
FIG. 12 shows a side elevation view of a simple base unit structure with a folded convex shaped top panel.

FIG. 12 shows a side elevation view of a simple base unit structure 2 with a folded convex shaped top panel. You can see the top panel 10 connects to the base unit structure 2.

Figure 13:
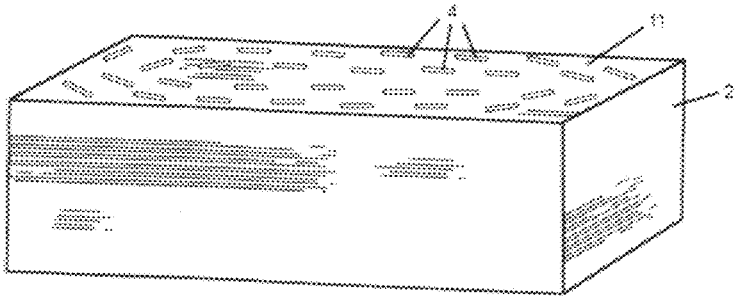
FIG. 13 shows a perspective view of a simple base unit structure with a flat top panel.

FIG. 13 shows a perspective view of a simple base unit structure 2 with a flat top panel 11. You can see the directioning slits 4 in the top of the panel 11. You can see the top panel 11 connects to the base unit structure 2.

Figure 14:
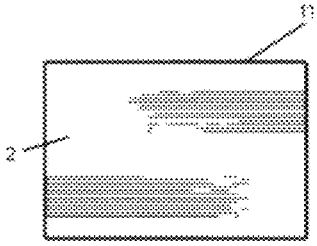
FIG. 14 shows a side elevation view of a simple base unit structure with a flat top panel.

FIG. 14 shows a side elevation view of a simple base unit structure 2 with a flat top panel 11. You can see the top panel 11 connects to the base unit structure 2.

Figure 15:
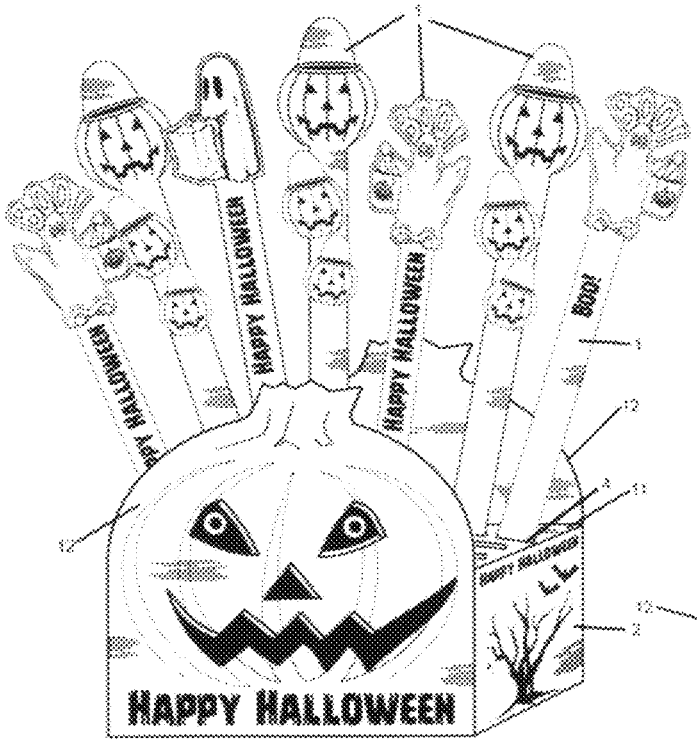
FIG. 15 shows a perspective view of an assembled display device with side walls of varying heights and shapes and inserted flat image panels with indicia.

FIG. 15 shows a perspective view of an assembled display device with indicia on individual flat image panels 1 and all outer walls of base unit structure 2. You can see in this theme design an example of walls 12 of varying shapes and height that extend up past the flat top panel 11. You can see individual flat image panels 1 going through the directioning slits 4 in the top panel 11.

Figure 16:
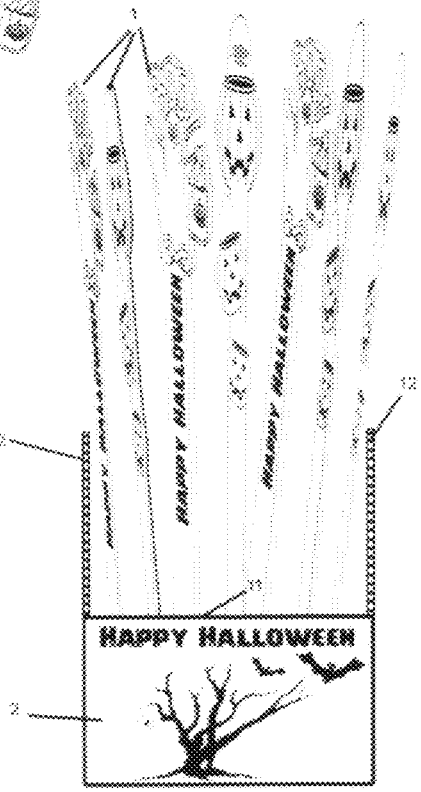
FIG. 16 shows a side elevation view of an assembled display device with side walls of varying heights and shapes and individual flat image panels with indicia.

FIG. 16 shows a side elevation view of an assembled display device with indicia on individual flat image panels 1 and all outer walls of the base unit structure 2. You can see in this theme design an example of walls 12 of varying shapes and height that extend up past the flat top panel 11. From this view you can see the facing angles of individual flat image panels 1 as they arc around to present a collective view from side angles.

Figure 17:
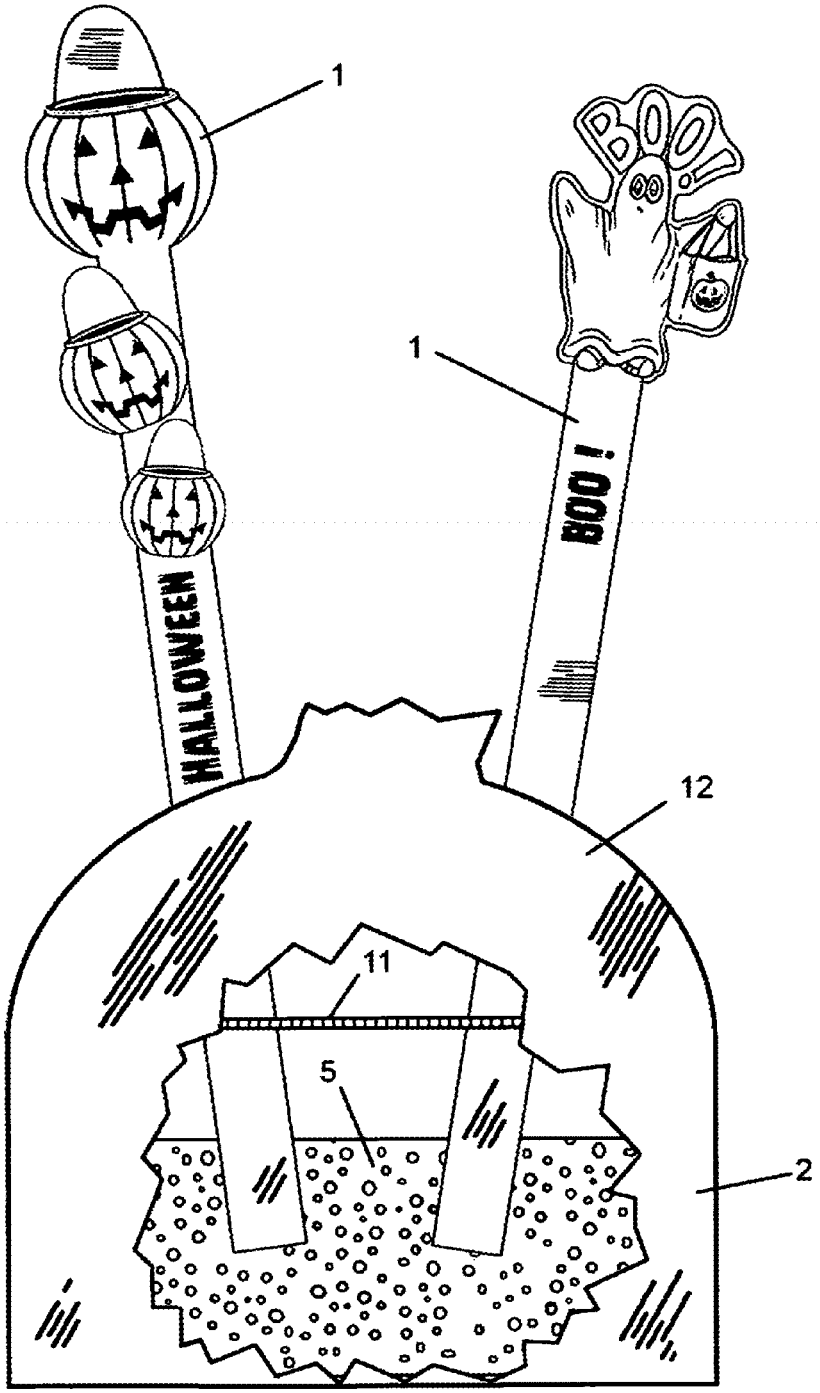
FIG. 17 shows a front elevation view of a display device with walls of varying heights and shapes, with cut-away view in the base unit structure and two image panels.

FIG. 17 shows a front elevation view with a cut-away of a base unit structure 2 with irregular walls 12. You can see two individual flat image panels 1 with indicia, passing through the flat top panel 11 and anchoring in the foam 5 within the base unit structure 2.

Figure 18:
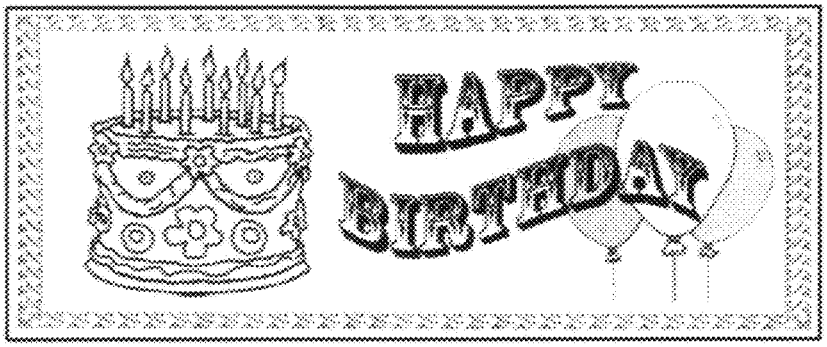
FIG. 18 shows the bottom outside facing wall of the base unit structure with indicia.

FIG. 18 shows a plan view of a bottom wall of the base unit structure with indicia on the outer face.

Figure 19:
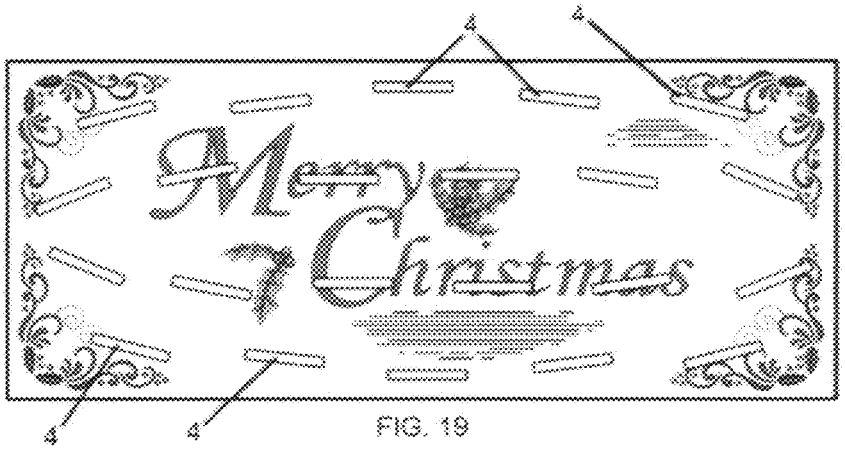
FIG. 19 shows a plan view of a flat top panel with indicia.

FIG. 19. shows a plan view of a flat top panel with indicia on the outer face. You can see the directioning slits cut through it.

Figure 20:
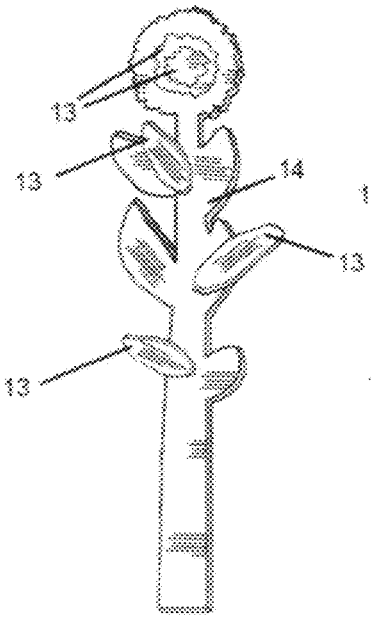
FIG. 20 shows a front elevation view of an individual multi-dimensional image panel.

FIG. 20 shows a front elevation view of a multi-dimensional image panel. Characters or elements 13 are attached to a flat image panel 14 creating dimension.

Figure 21:
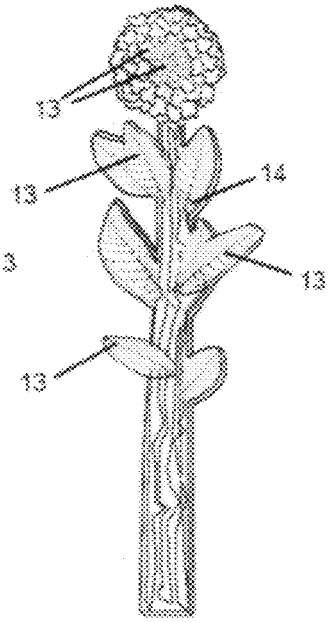
FIG. 21 shows a front elevation view of an individual multi-dimensional image panel with indicia on all outer facing sides.

FIG. 21 shows a front elevation view of a multi-dimensional image panel with indicia on all outer surfaces. Characters or elements 13 are attached to a flat image panel 14 creating dimension.

Figure 22:
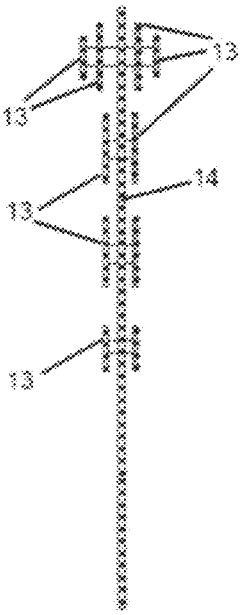
FIG. 22 shows a side elevation view an individual multi-dimensional image panel.

FIG. 22 shows a side elevation view of a multi-dimensional image panel. Simple paper construction methods are employed to attach the elements 13 to a flat image panel 14.

Figure 23:
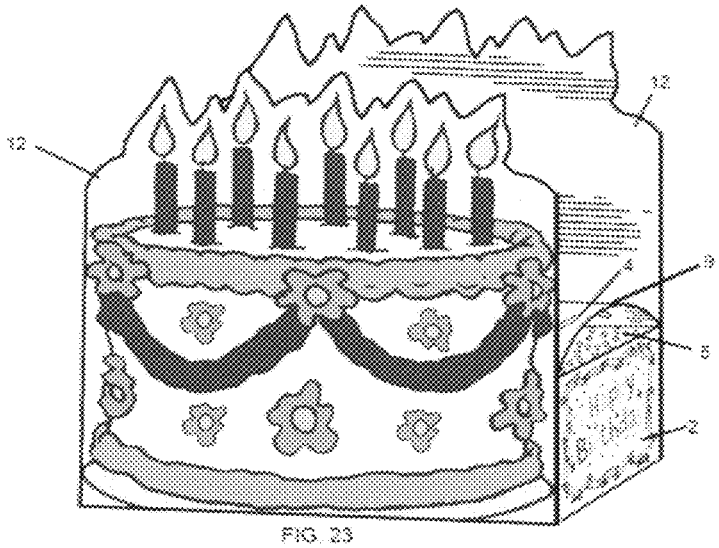
FIG. 23 shows a perspective view of an assembled base unit structure with side walls of varying heights and shapes with indicia, assembled.

FIG. 23 shows a perspective view of an assembled base unit structure 2 with indicia on outer side walls 12. You can see in this theme design an example of irregular walls 12 of varying shapes and heights that extend up past the curved convex shaped top panel 9. You can see foam 5 inside the base unit structure 2. The curved convex shaped top panel 9 is represented without indicia on it to be able to see the directioning slits 4 clearly.

Figure 24:
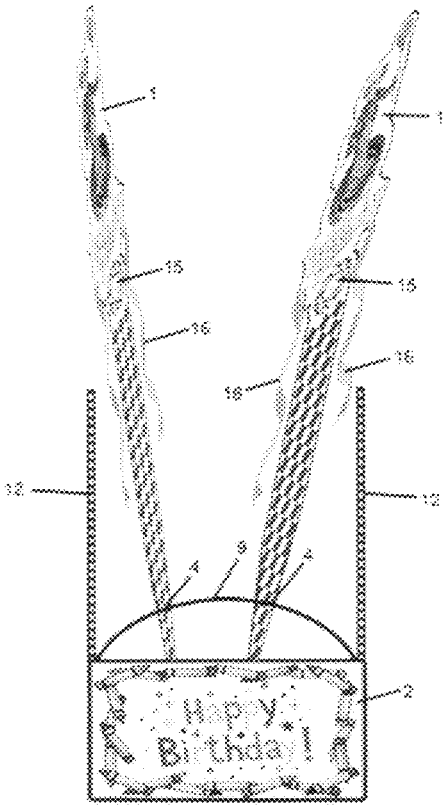
FIG. 24 shows a side elevation view of an assembled base unit structure with two individual flat image panels placed.

FIG. 24 shows a side elevation view of an assembled base unit structure 2. You can see in this theme design an example of side walls 12 of varying shapes and heights that extend up past the curved convex shaped top panel 9. From this view you can see a partial angled view of the flat sides of the individual flat image panels 1 as they arc around to present a collective view from side angles. You can see where the bottoms of the flat image panels 1 go through the directioning slits 4 in the top panel 9.

Figure 25:
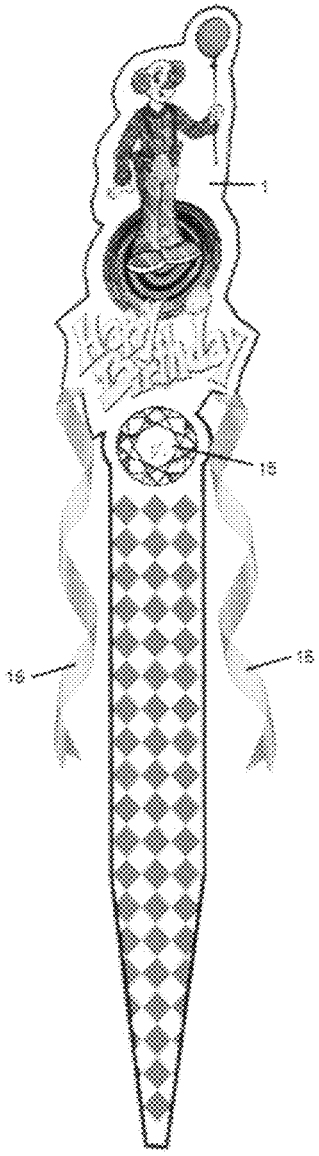
FIG. 25 shows a front elevation view of an individual flat image panel with embellishments of artificial jewels and ribbons.

FIG. 25 shows a front elevation view of an individual flat image panel with added embellishments artificial jewels 15 and ribbons 16.

We claim:

1. A three dimensional visual display device kit comprising:

a collapsible base unit structure having a bottom wall, generally vertical flat side walls of varying heights and shapes, a partially folded gabled top panel with a plurality of directioning slits in it, a multitude of individual placeable flat panels generally formed from paper materials with indicia adapted to be disposed on one or both sides, said individual flat panels having a variety of shaped contours and widths and lengths with a bottom section not wider or thicker than said directioning slits in top panel so as to be passable through, said directioning slits in top panel a means of spacing and setting direction of said inserted flat panels, said top panel, also means to support flat panels in generally upright and outward angles from said base unit structure through said directioning slits, said top panel also means to hide said base unit structure cavity and solid foam disposed within from plain view, said solid foam disposed within base unit structure to receive bottom portions of said flat panels into, a stable means of anchoring and securing bottom portions of said flat panels by decompression force, said base unit structure formed from paper materials, and indicia adapted to be disposed on outer facing of all outer side walls, bottom wall and top panel.

2. A three dimensional visual display device kit as in claim 1 wherein said flat panels are formed of transparent materials.

3. A three dimensional visual display device kit as in claim 1 wherein said flat panels are formed of plastic materials.

4. A three dimensional visual display device kit as in claim 1 wherein said flat panels have multi-dimensional, elements, indicia adapted to be disposed on outer facing of all sides.

5. A three dimensional visual display device kit as in claim 1 wherein said base unit structure formed of plastic materials, indicia adapted to be disposed on outer facing of all sides.

6. A three dimensional visual display device kit as in claim 1 wherein said top panel is flat.

7. A three dimensional visual display device kit as in claim 1 wherein said top panel is curved convex or folded convex with indicia disposed on outer face.

* * * * *